US006651873B2

(12) United States Patent
Quaintance

(10) Patent No.: US 6,651,873 B2
(45) Date of Patent: Nov. 25, 2003

(54) CONTAINER WITH BAG CUFF GRAB MEANS

(75) Inventor: Benjamin Quaintance, Germantown, TN (US)

(73) Assignee: International Paper Company, Tuxedo, NY (US)

( * ) Notice: Subject to any disclaimer, the term of this patent is extended or adjusted under 35 U.S.C. 154(b) by 0 days.

(21) Appl. No.: 10/205,025

(22) Filed: Jul. 25, 2002

(65) Prior Publication Data

US 2003/0019919 A1 Jan. 30, 2003

Related U.S. Application Data

(60) Provisional application No. 60/307,681, filed on Jul. 25, 2001.

(51) Int. Cl.[7] ..... B65D 5/60; B65D 25/16

(52) U.S. Cl. ..... 229/109; 220/495.11; 229/108; 229/110; 229/117.35; 229/918

(58) Field of Search ..... 229/108, 109, 229/110, 117.27, 117.35, 191, 906, 915, 918; 220/495.08, 495.1, 495.11

(56) References Cited

U.S. PATENT DOCUMENTS

| | | | | | |
|---|---|---|---|---|---|
| 1,482,727 | A | * | 2/1924 | Borchers | 229/110 |
| 3,610,514 | A | * | 10/1971 | Samsing | 229/108 |
| 3,684,155 | A | * | 8/1972 | Smith | 229/117.35 |
| 3,918,630 | A | * | 11/1975 | Meyers | 229/191 |
| 4,056,223 | A | * | 11/1977 | Williams | 229/918 |
| 4,151,948 | A | * | 5/1979 | de la Fuente, Jr. | 229/918 |
| 4,338,979 | A | * | 7/1982 | Dow | 220/495.11 |
| 4,417,686 | A | * | 11/1983 | Wozniacki | 229/191 |
| 4,850,527 | A | * | 7/1989 | Church et al. | 229/110 |
| 4,892,223 | A | * | 1/1990 | DeMent | 229/117.35 |
| 5,018,637 | A | * | 5/1991 | Miller | 229/117.35 |
| 5,054,724 | A | * | 10/1991 | Hutcheson | 229/117.35 |
| 5,586,716 | A | * | 12/1996 | Correll | 229/110 |
| 5,752,648 | A | * | 5/1998 | Quaintance | 229/918 |
| 5,755,377 | A | * | 5/1998 | Durand | 229/110 |

FOREIGN PATENT DOCUMENTS

| | | | | |
|---|---|---|---|---|
| DE | 3933372 A | * | 4/1991 | 229/191 |
| JP | 6156605 A | * | 6/1994 | 220/495.11 |

* cited by examiner

*Primary Examiner*—Gary E. Elkins
(74) *Attorney, Agent, or Firm*—Dennis H. Lambert

(57) ABSTRACT

A container made from corrugated paperboard has at least one mitered corner, with an extended edge portion of one of the container walls extending beyond the mitered corner. A bag cuff grab is formed on the extended edge portion to engage and at least temporarily hold in position a bag placed in the container while product is placed in the bag and container. In one embodiment, the container has six sides, with two side walls, two end walls, and two mitered corners. In another embodiment, the container has seven sides, with two side walls, two end walls, and three mitered corners. In a third embodiment, the container has eight sides, with two side walls, two end walls, and four mitered corners. A bag cuff grab can be formed on an extended edge portion at only one or all of the mitered corners, and can be limited to two bag cuff grabs on extended edge portions at diagonally opposite mitered corners. In a preferred embodiment, the bag cuff grab is a notch formed in the extended edge portion.

9 Claims, 5 Drawing Sheets

FIG. 5
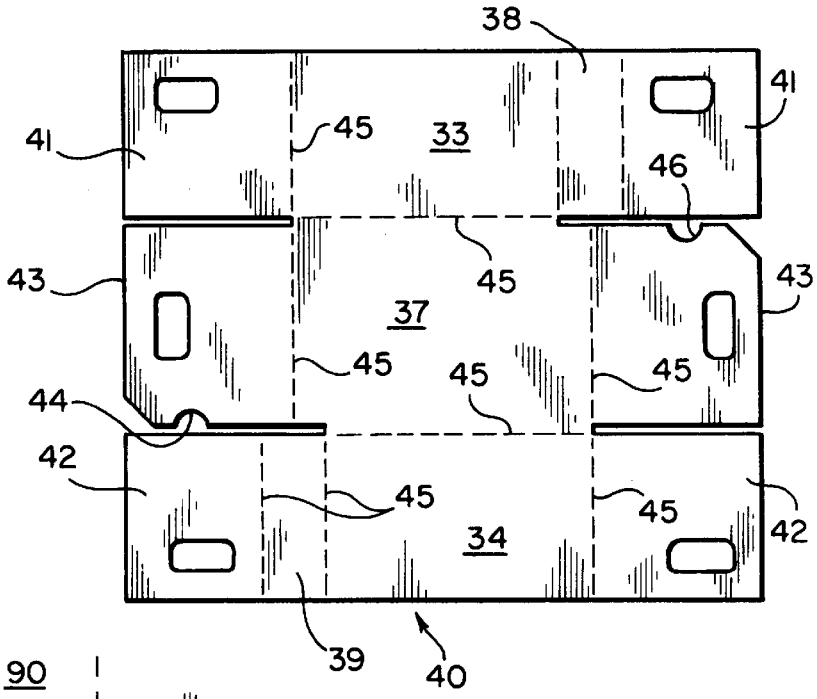
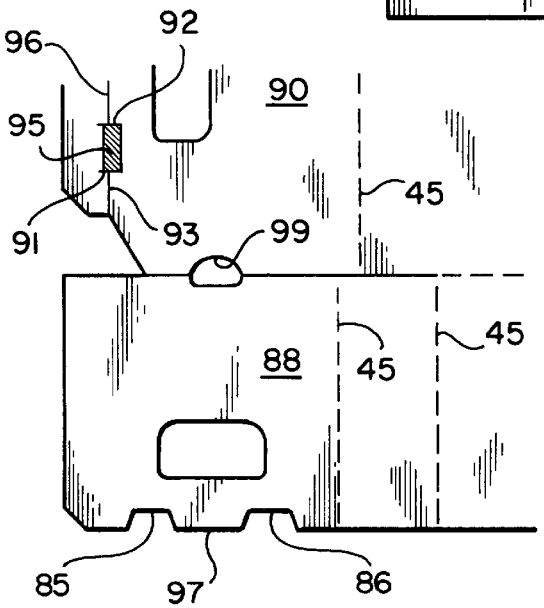
FIG. 16
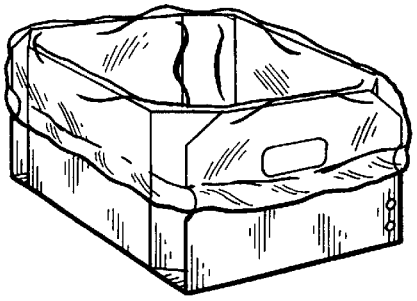
FIG. 17
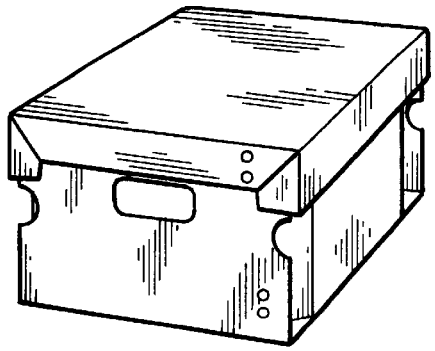
FIG. 18

CONTAINER WITH BAG CUFF GRAB MEANS

This application claims the benefit of U.S. Provisional Application No. 60/307,681, filed Jul. 25, 2001, entitled "Poultry Pack".

BACKGROUND OF THE INVENTION

1. Field of the Invention

This invention relates to packaging. More specifically, the invention relates to a multi-sided container or box made of corrugated paperboard. In particular, the invention relates to a corrugated paperboard tray for containing poultry products, wherein the tray has means for temporarily holding in place the open end of a bag placed in the container while product is placed in the bag.

2. Prior Art

Various styles of containers, including paperboard boxes, are known in the prior art for containing a variety of products. Cut poultry pieces, for example, are normally packed in ice in a paperboard container. These containers are generally referred to as poultry trays, and are usually made from a unitary blank of corrugated paperboard, which may be treated on one or both sides with wax or other material to impart rigidity and resistance to water degradation. Conventional containers may have four sides and be square or rectangular in plan view, or they may have eight sides, with opposed pairs of parallel side and end walls and diagonal corner panels connecting adjacent side and end walls. An example of a prior art eight sided poultry tray is disclosed in applicant's U.S. Pat. No. 5,752,648.

In many instances a flexible bag is placed in the container with the open top of the bag exposed through the open top of the container, and the product is placed in the bag through its open top, which is then closed over the product. After the bag is closed over the product, a cover is typically placed on the container.

In conventional systems the open top of the bag is folded outwardly over the open top of the container, and the product is placed in the bag. However, the weight and/or friction of the product acting on the bag sometimes causes the open top of the bag to drop into the box, or at least some of the bag to be displaced into the container, with the result that not all of the product is confined within the bag and/or it may be difficult to close the open top of the bag over the product after the container is filled.

Accordingly, there is need for a container that has means for at least temporarily holding a bag in position in the container while product is introduced into the bag.

SUMMARY OF THE INVENTION

The container of the invention has means associated with it to at least temporarily hold a bag in place in the container while product is placed in the bag.

More specifically, in accordance with the invention means is provided on an exterior surface of the container which cooperates with the open top end of a bag placed in the container to hold the bag in position while product is placed in the bag.

In particular, the container of the invention has at least one mitered corner and an adjacent wall of the container extends at one edge past the mitered corner. Bag cuff grab means is formed on the extended edge to grab and hold in place the open top of the bag while product is placed in it. The invention may be applied to a container having any number of mitered corners, although in the embodiments illustrated and described herein, it is applied to containers having six, seven or eight sides, with two, three or four mitered corners, respectively. A bag cuff grab means may be formed at only one mitered corner, or diagonally opposed corners, or any number of them, as desired or necessary.

The bag cuff grab means can comprise any suitable means, but in the embodiments illustrated and described herein, it comprises a notch formed in the edge of the extended wall panel. The open top edge of the bag is folded or rolled outwardly and then downwardly over the open top edge of the container and engaged in the notch, which then functions to hold the bag in place while it is being filled. Preferably, the open top end of the bag is rolled to form a cuff, and the cuff is engaged in the notch, which functions as a cuff grab.

The invention is a simple, economical and effective way to at least temporarily hold the open top end of a bag in position in a container while product is placed in the bag. It adds no cost to the container.

BRIEF DESCRIPTION OF THE DRAWINGS

The invention is described in greater detail hereinafter with reference to the drawings, wherein like reference characters designate like parts throughout the several views, and wherein:

FIG. 5 is a plan view of a blank for making the six sided tray of FIG. 3, showing how cuts are made in edges of the end panels to form the bag cuff grab.

FIG. 16 is an enlarged fragmentary plan view of a portion of the blank used in making the container of FIG. 13, showing details of the self locking feature.

FIG. 17 is a top perspective view of a container incorporating the bag cuff grab of the invention, showing a bag in place and rolled over to form a cuff that is engaged in the notches forming the bag cuff grab.

FIG. 18 is a top perspective view of a container of the invention, showing a cover in place on the container.

DETAILED DESCRIPTION OF THE PREFERRED EMBODIMENTS

Figure 1:
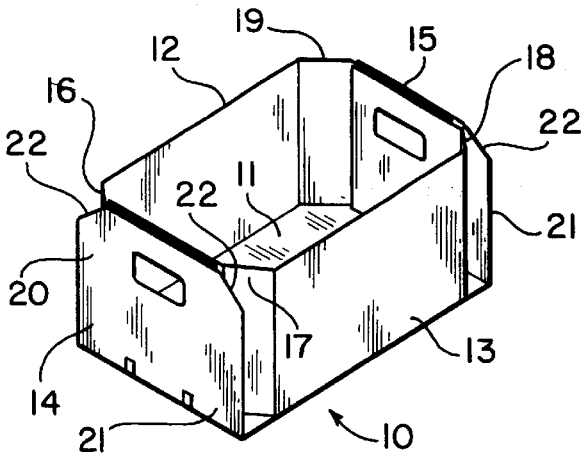
FIG. 1 (PRIOR ART)
FIG. 1 is a top perspective view of a conventional eight sided container having mitered corners, in which opposed pairs of parallel side and end walls are joined by diagonal corner panels in each of the corners of the tray.
Figure 2:
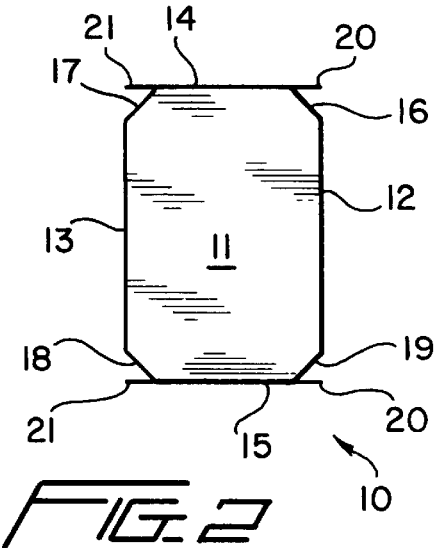
FIG. 2 (PRIOR ART)
FIG. 2 is a schematic top plan view of the tray of FIG. 1.
Figure 6:
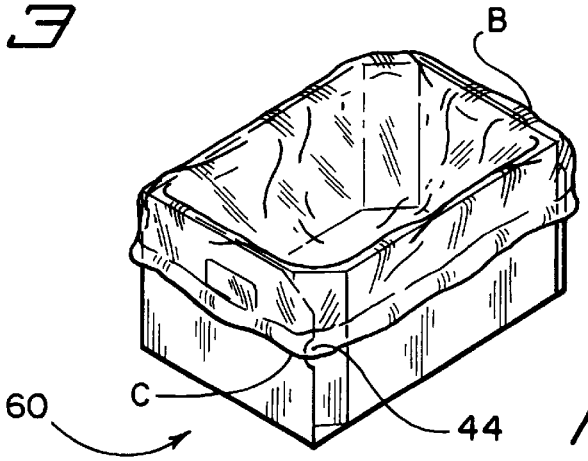
FIG. 6 is a top perspective view depicting the six sided container having a plastic bag in place for receiving product, with the open end of the bag rolled to form a cuff that is engaged in the notch.

A conventional eight sided container, e.g., a poultry tray, is depicted at 10 in FIGS. 1 and 2. The tray 10 comprises a bottom wall 11, opposite parallel side walls 12 and 13, opposite parallel end walls 14 and 15, and mitered corners comprised of diagonal corner panels 16, 17, 18 and 19 connecting the side and end walls at adjacent ends. The width of the end walls 14 and 15 is such that they project at their opposite side edges 20, 21 beyond the diagonal corner panels, terminating at their outer edges substantially in alignment with the plane of the side walls 12 and 13. The upper outer corners of the side edges 20, 21 are cut away at 22. As shown in FIG. 18, a cover is typically placed on the tray, and a plastic bag is also sometimes inserted into the tray to receive the product (see FIGS. 6 and 17, for example).

Figure 3:
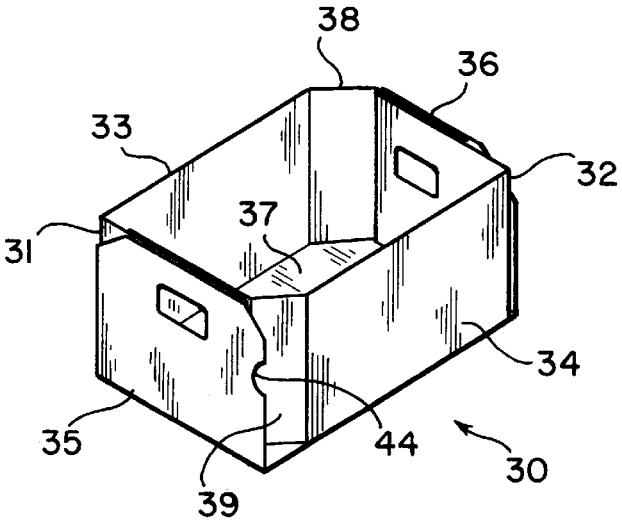
FIG. 3 is a top perspective view of a first embodiment of the invention, wherein the container is a six sided poultry tray configured for machine set up, in which two diagonally opposed corners of the tray are mitered and the remaining two corners are square, with the bag cuff grab of the invention formed on the extended outer edge of the end walls at the mitered corners.
Figure 4:
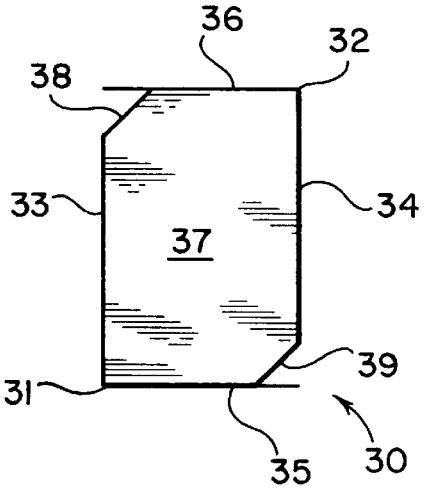
FIG. 4 is a schematic top plan view of the six sided tray of FIG. 3.

A first preferred embodiment of the container or tray of the invention is indicated generally at 30 in FIGS. 3–5. In this form of the invention two diagonally opposite corners 31 and 32 of the tray are squared, producing a six sided tray having two parallel side walls 33 and 34, two parallel end walls 35 and 36, a bottom wall 37, two opposed diagonal corner panels 38 and 39, and the two diagonally opposed square corners 31 and 32. With this arrangement the tray resists distortion better than an eight sided tray, especially at the open top edge, when a lateral force is applied to the sides or ends of the tray. Better and more reliable cover fit is also obtained, and it also has significantly greater crush or stacking strength than a comparably sized four sided tray.

In the particular form shown in FIGS. 3 and 5, the six sided tray is configured for machine set up, although it should be understood that the invention is equally applicable to containers that are manually set up. In the machine set up version shown here, the end panels 41, 42 and 43 at opposite ends of the blank 40 (see FIG. 5) are glued to one another in a machine operation to produce the tray shown in FIG. 3. The respective panels and walls are joined to adjacent structures via fold lines, indicated by the dashed lines 45.

Notches 44 and 46 are formed in one side edge of each of end panels 43, in diagonally opposed relationship to one another. When the container is erected, these notches form a bag cuff grab which catches and holds the cuff "C" of a bag "B" placed in the tray, see FIGS. 6 and 17, to hold the bag in place and facilitate filling of the bag. In this regard, although the open top end of the bag is shown rolled over to form the cuff "C", the cuff is not necessary to operation of the invention.

Figure 7:
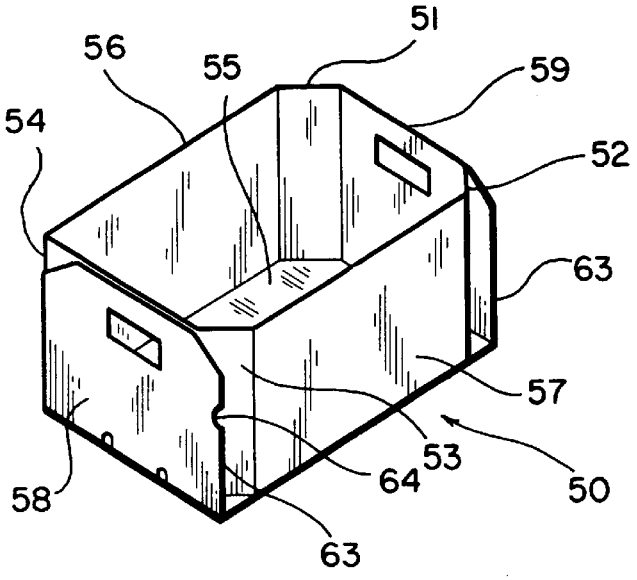
FIG. 7 is a top perspective view of a second embodiment of the invention, wherein the container has seven sides, and a bag cuff grab is provided at two diagonally opposite corners.
Figure 8:
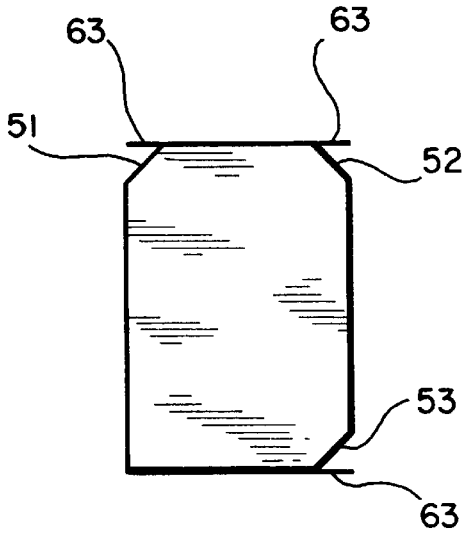
FIG. 8 is a schematic top plan view of the seven sided tray of FIG. 7.
Figure 9:
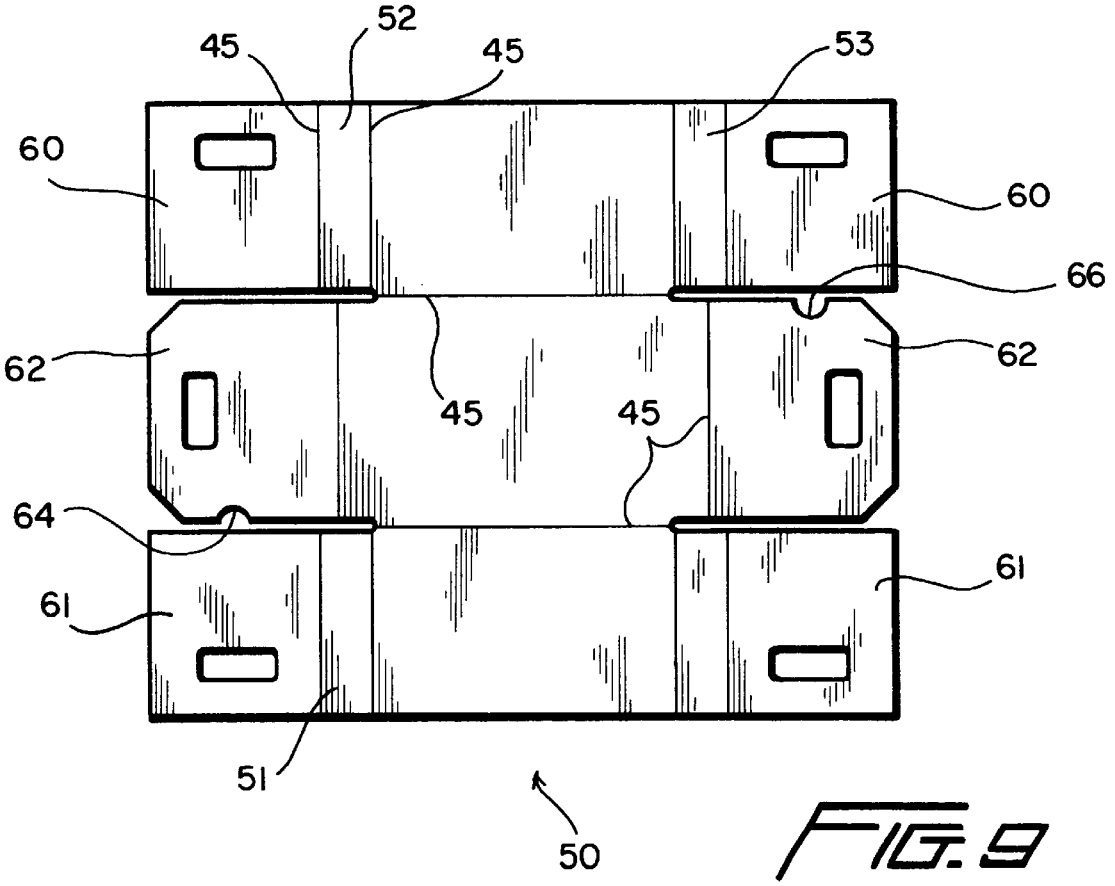
FIG. 9 is a plan view of a blank for making the seven sided tray of FIG. 7.

A second embodiment of the invention is indicated at 50 in FIGS. 7–9, wherein the container has seven sides. In this form of the invention, the container has three corners 51, 52 and 53 oriented diagonally and only one corner 54 that is squared, producing a seven sided container. The container 50 has a bottom wall 55, opposed parallel side walls 56 and 57, opposed parallel end walls 58 and 59, diagonal corner panels 51, 52 and 53, and the single square corner 54. As seen best in FIG. 9, which depicts the unitary paperboard blank from which the container 50 is erected, the end walls each comprise end panels 60, 61 and 62, which are overlapped and glued together by machine in setting up the container.

Extended edges 63 of the end panels 62 extend beyond the diagonal corner panels, and notches 64 and 66 are formed in one side edge of each of end panels 62, in diagonally opposed relationship to one another. When the container is erected, these notches form a bag cuff grab which catches and holds the cuff "C" of a bag "B" placed in the tray, see FIGS. 6 and 17, to hold the bag in place and facilitate filling of the bag. In this regard, although the open top end of the bag is shown rolled over to form the cuff "C", the cuff is not necessary to operation of the invention.

Figure 10:
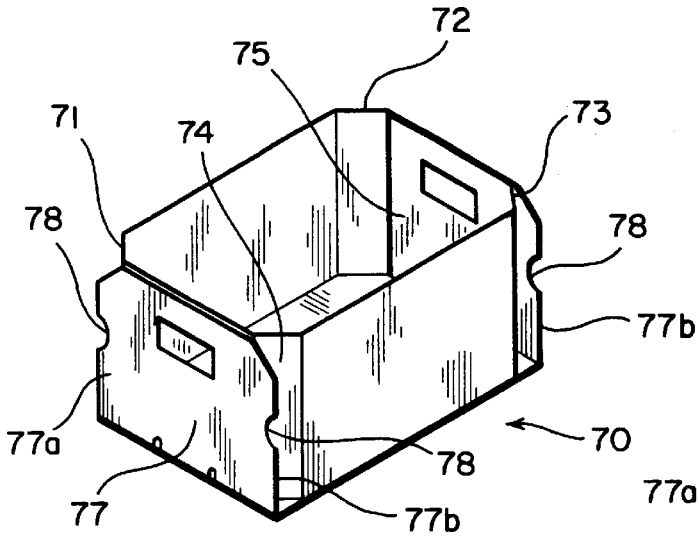
FIG. 10 is a top perspective view of a third embodiment, in which the container has eight sides, with four mitered corners, and is configured for machine set up.
Figure 11:
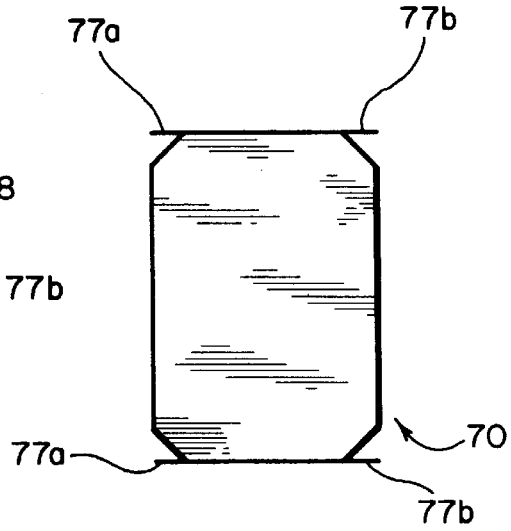
FIG. 11 is a schematic top plan view of the third embodiment.
Figure 12:
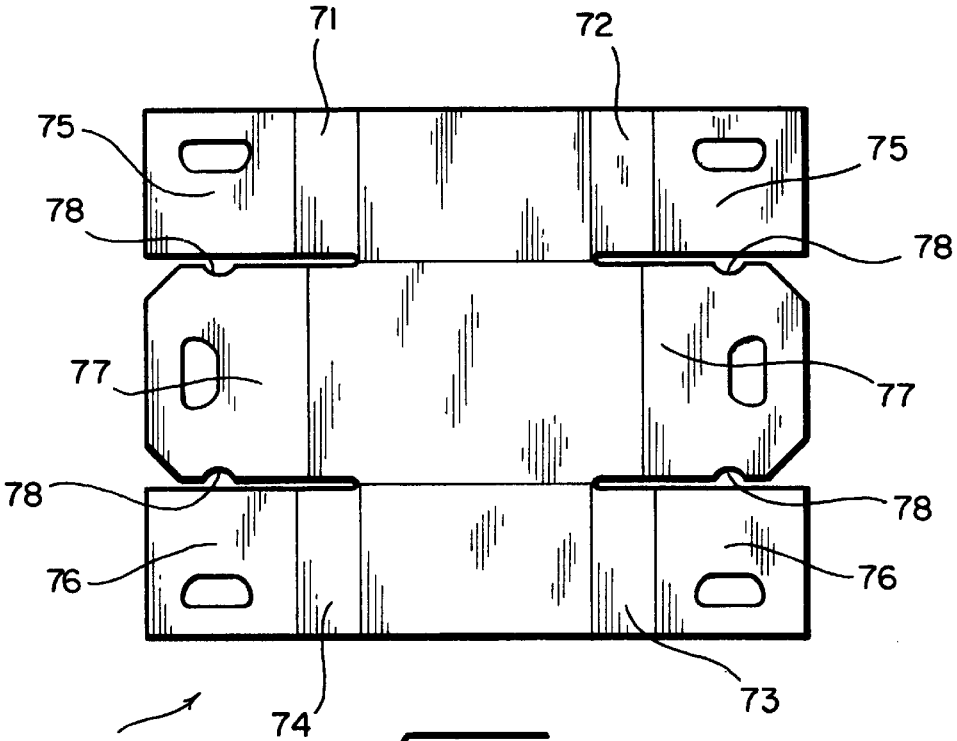
FIG. 12 is a plan view of the blank used in making the container of FIG. 10.
Figure 13:
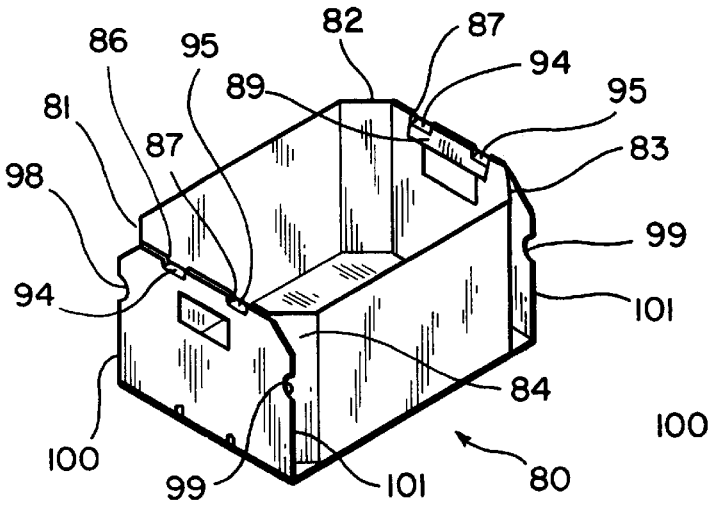
FIG. 13 is a top perspective view of a fourth embodiment, in which the container has eight sides, with four mitered corners, and is configured for manual set up.
Figure 14:
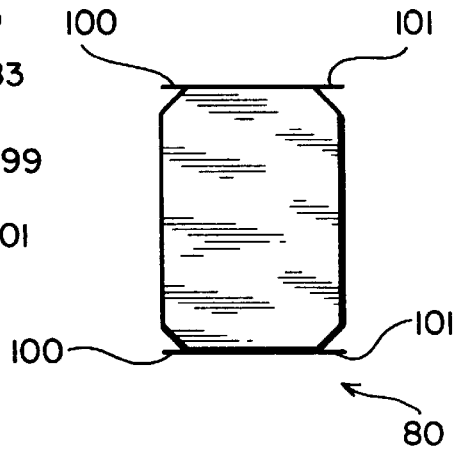
FIG. 14 is a schematic top plan view of the fourth embodiment.
Figure 15:
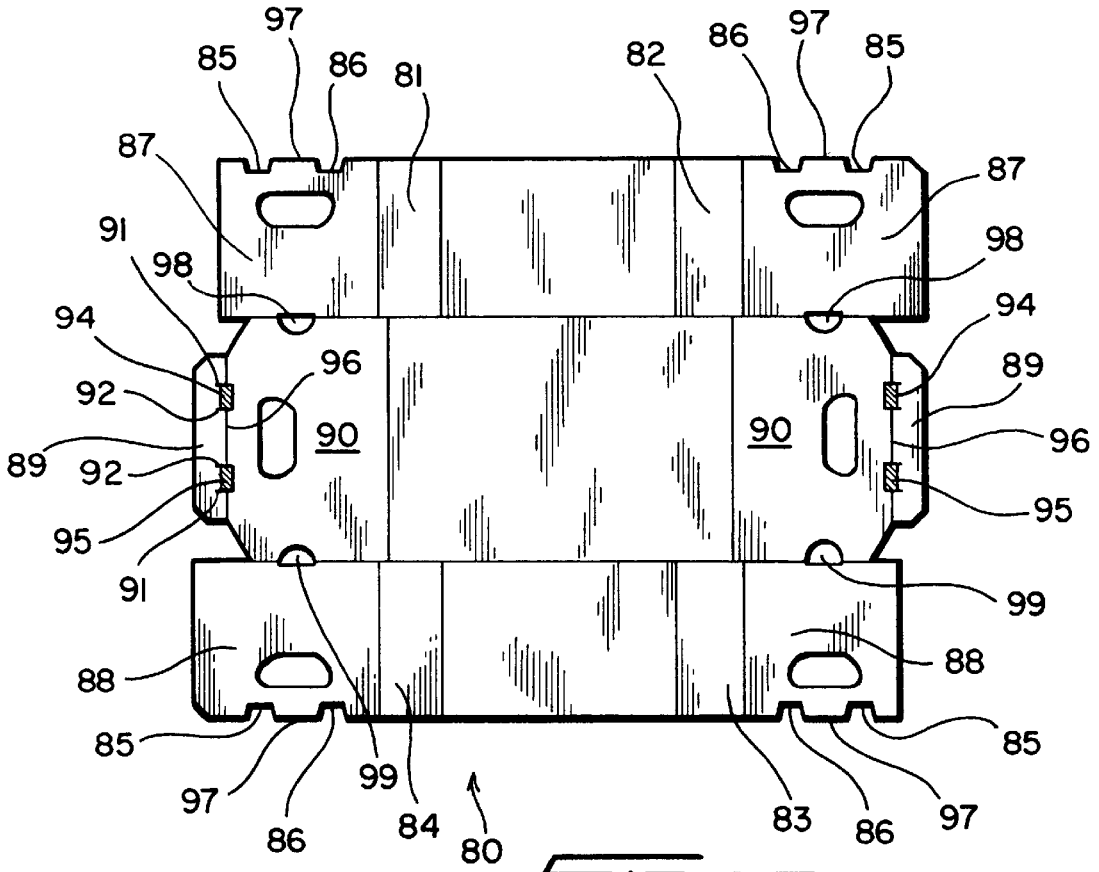
FIG. 15 is a plan view of the blank used in making the container of FIG. 13.

A third embodiment of the invention is shown 70 in FIGS. 10–12. In this form of the invention, the container has eight sides, with four mitered corners or diagonal corner panels 71, 72, 73 and 74. The container 70 shown in these figures is configured for machine set up, and end panels 75 and 76 are folded inwardly and glued to the inside of end panels 77.

Notches 78 are formed in the opposite extended side edges 77*a* and 77*b* of each end panel 77, forming a bag cuff grab as in previous embodiments, but in this form of the invention, a notch is formed at each of the mitered corners, rather than just on diagonally opposite corners. However, only one notch in one corner, or two diagonally opposed notches, or any other suitable arrangement could be used, as desired or necessary.

A fourth embodiment of the invention is shown at 80 in FIGS. 13–16. In this embodiment, the container is eight sided as in the immediately preceding embodiment, with four mitered corners or diagonal corner panels 81, 82, 83 and 84, but is configured for manual set up. Notches 85 and 86 in the top edge of end panels 87 and 88 interlock with a roll over flap 89 on the top edge of end panels 90. Pairs of cuts 91 and 92 are made transversely across the cut line 93 made between the roll over flap and its associated end panel 90, and these cuts are spaced apart a distance approximately the same as the width of the notches 85 and 86. These cuts define short, narrow webs 94 and 95 that foldably connect the roll over panel to the end panel 90. In a preferred form, the webs are crushed from the inside of the container. Thus, when the roll over flap is folded inwardly over the top edge of the overlapped end panels, the webs extend more deeply and smoothly into the notches, forming a tight joint that effectively resists dislodgement. The cut 93 defines a slot through which the tabs 97 formed between the notches 85 and 86 extend when the roll over flap is in folded and locked position.

Notches 98 and 99 are cut in the opposite extended side edges 100, 101 of the end panels 90, forming bag cuff grabs in the erected container. A notch is formed at each of the mitered corners, rather than just on diagonally opposite corners, but only one notch in one corner, or two diagonally opposed notches, or any other suitable arrangement could be used, as desired or necessary.

Although particular embodiments of the invention are illustrated and described in detail herein, it is to be understood that various changes and modifications may be made to the invention without departing from the spirit and intent of the invention as defined by the scope of the appended claims.

What is claimed is:

1. In a multi-sided container having opposite side walls, opposite end walls, at least one mitered corner, and an extended edge portion of at least one said wall extending beyond the mitered corner, wherein a bag is placed in the container for holding product, the improvement comprising:

bag cuff grab means on said extended edge portion for at least temporarily engaging and holding an open end of the bag to hold the bag in place in the container while product is introduced into the bag and container.

2. A container as claimed in claim 1, wherein:

the container has six sides, including said side walls, said end walls, and two diagonally opposite mitered corners, and an extended edge portion extends beyond each of said mitered corners, and there are bag cuff grab means on said extended edge portions at each of said two diagonally opposite mitered corners.

3. A container as claimed in claim 2, wherein:

the mitered corners comprise diagonal corner panels.

4. A container as claimed in claim 2, wherein:

the container end walls each comprise a plurality of overlapping end panels, and said extended edge portion is on at least one of said end panels.

5. A container as claimed in claim 1, wherein:

the bag cuff grab means comprises a notch formed in the extended edge portion.

6. A container as claimed in claim 1, wherein:

the container has seven sides, including said side and end walls, and three mitered corners, and said bag cuff grab means is at at least one mitered corner.

7. A container as claimed in claim 1, wherein:

the container has eight sides, with two opposite parallel side walls, two opposite parallel end walls, and four mitered corners, and said bag cuff grab means is at at least one mitered corner.

8. A container as claimed in claim 7, wherein:

bag cuff grab means are at more than one mitered corner.

9. A container as claimed in claim 8, wherein:

bag cuff grab means are at each of the four mitered corners.

* * * * *